US005731056A

United States Patent [19]

Butler, III

[11] Patent Number: 5,731,056

[45] Date of Patent: Mar. 24, 1998

[54] RIGID STRUCTURE ATTACHMENT USING HOOK AND LOOP FASTENERS

[75] Inventor: George H. Butler, III, Mesa, Ariz.

[73] Assignee: McDonnell Douglas Helicopter Company, Meza, Ariz.

[21] Appl. No.: 661,825

[22] Filed: Jun. 11, 1996

[51] Int. Cl.[6] ..... B32B 3/06

[52] U.S. Cl. ..... 428/100; 24/306; 24/442; 24/444; 428/40.1; 428/99; 428/131

[58] Field of Search ..... 428/40.1, 100, 428/99, 131; 24/444, 442, 306

[56] References Cited

U.S. PATENT DOCUMENTS

| | | | |
|---|---|---|---|
| 3,063,749 | 11/1962 | Struble | 428/100 |
| 3,475,810 | 11/1969 | Mates | 29/426.5 |
| 3,807,112 | 4/1974 | Perina | 52/241 |
| 3,905,071 | 9/1975 | Brumlik | 24/442 |
| 4,531,733 | 7/1985 | Hall | 24/444 |
| 4,556,167 | 12/1985 | Fox | 24/444 |
| 4,863,127 | 9/1989 | Handler | 248/205.2 |
| 4,870,725 | 10/1989 | Dubowik | 24/442 |
| 5,133,166 | 7/1992 | Pacione | 52/483 |
| 5,203,053 | 4/1993 | Rudd | 24/442 |

*Primary Examiner*—Nasser Ahmad

*Attorney, Agent, or Firm*—Donald E. Stout; Kenton R. Mullins

[57] ABSTRACT

A securing system includes a primary structure and a first strip of hook and loop fasteners adapted to be secured thereon. A secondary structure includes a plurality of apertures disposed therein. The plurality of apertures fit over the first strip of hook and loop fasteners when the secondary structure is placed onto the primary structure. A second strip of hook and loop fasteners is adapted for fitting over the plurality of apertures of the secondary structure and for contacting portions of the first strip of hook and loop fasteners through the plurality of apertures. The contacting of the first and second strips of hook and loop fasteners secures the primary structure to the secondary structure. The second strip of hook and loop fasteners is flexible, and is removable from the plurality of apertures with only a relatively small removal force, compared to the removal force required to remove a second rigid strip of hook and loop fasteners from the first strip of hook and loop fasteners on the primary structure.

25 Claims, 6 Drawing Sheets

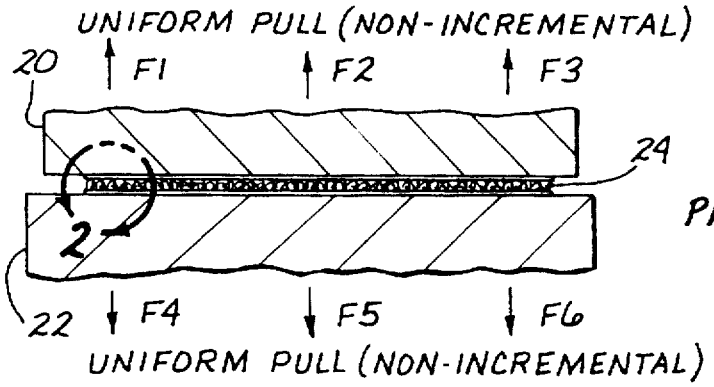
Fig. 1
PRIOR ART
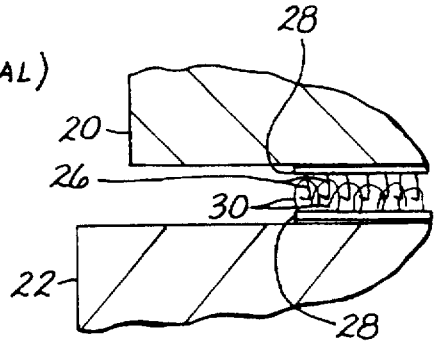
Fig. 2
PRIOR ART
Fig. 3
PRIOR ART
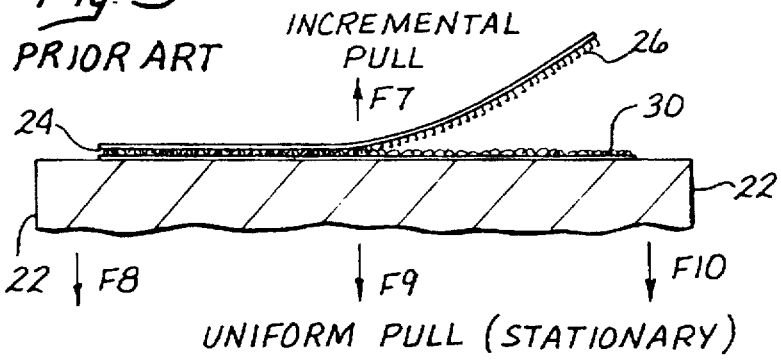
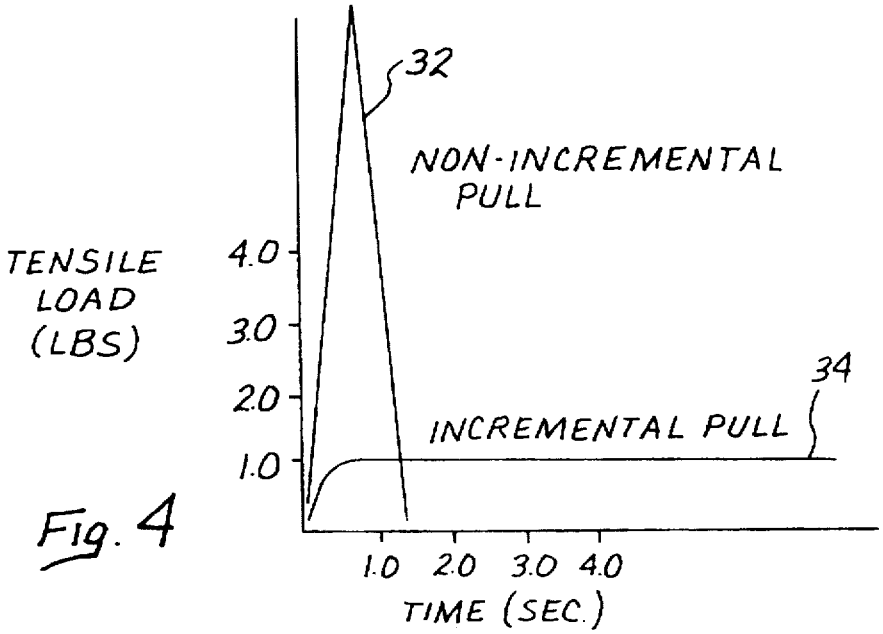
Fig. 4

RIGID STRUCTURE ATTACHMENT USING HOOK AND LOOP FASTENERS

BACKGROUND OF THE INVENTION

1. Field of the Invention

The present invention relates generally to fastening devices and, more particularly, to hook and loop fasteners used in conjunction with rigid structures.

2. Description of Related Art

Hook and loop fasteners have been used for a variety of purposes. A typical hook and loop fastener includes a first strip of tiny hooks, which is secured to a first structure, and a second strip of tiny loops, which is secured to a second structure. The first and second strips are secured to the respective first and second structures using either needle and thread or adhesion, for example. The two structures can be secured together by bringing the first strip into contact with the second strip, thus allowing the tiny hooks to enter the tiny loops.

A typical hook and loop fastening system works best when at least one of the first structure or the second structure is somewhat flexible. The two structures may be easily disconnected by gripping an end of the flexible structure and progressively pulling the flexible structure away from the other structure along the length of the hook and loop fasteners. When two rigid structures are Joined together using hook and loop fasteners, on the other hand, the only way to separate the two structures is to supply a separating force along the entire length of the hook and loop fasteners, at the same time. Even when hook and loop fasteners are used with flexible structures, variances in vibration and bending between the two structures may result in damage to either of the structures, or debonding of the hook and loop strips from the structures.

A number of systems exist in the prior art for removably connecting two rigid structures. A very common system uses nuts and bolts, and apertures within the two rigid structures for accommodating the bolts. Connecting the two rigid structures using nuts and bolts first requires the placement of the apertures in each of the two rigid structures. The nuts and bolts must then be secured within and around the apertures using tools. In addition to the requirement of tools, a significant amount of time is required for the installation and removal of the nuts and bolts associated with each connection and disconnection of the two rigid members. Another disadvantage associated with use of nuts and bolts for joining two rigid members stems from the difficulty of aligning the apertures of the first and second rigid members together, before feeding the bolts therethrough.

FIG. 1 illustrates a primary rigid structure 20 secured to a second rigid structure 22, using a hook and loop fastening system 24. As shown in FIG. 2, the hook and loop fastening system 24 includes a number of hooks 26 and a number of loops 30. The hooks 26 are bonded to the primary rigid structure 20 using an adhesive 28 and, similarly, the loops 30 are bonded to the secondary rigid structure 22 using an adhesive 28. When neither the primary rigid structure 20 nor the secondary rigid structure 22 are bendable, the only way to separate the two rigid structures 20, 22 is to apply a uniform pulling force, indicated by the arrows F1, F2 and F3 on the primary rigid structure 20 while applying a similar opposite force, indicated by the arrows F4, F5 and F6 on the secondary rigid structure 22.

The uniform pulling forces on the primary rigid structure 20 and on the secondary rigid structure 22 must disengage all of the hooks 26 from the loops 30 at approximately the same time. Often the strength of the adhesive 28 is not sufficient, and either the hooks 26 or the loops 30, or both, are ripped from their respective rigid structures 20, 22. In other cases where the adhesive 28 is very strong, damage to either the primary rigid structure 20 or the secondary rigid structure 22 may result from the uniform pulling forces. For example, either of the two rigid structures 20, 22 may crack or break during the separating process.

FIG. 3 illustrates an incremental pulling force F7 being applied to the hooks 26. Hook and loop fastening systems separate best when the pulling forces are incrementally applied, as shown in this figure. The force F7 acts only along a portion of the hook and loop fastening system 24, and is counteracted by the three forces F8, F9 and F10 on the secondary rigid structure 22.

FIG. 4 graphically describes the difference in separation forces required for separating two rigid structure (FIG. 1) and for separating one or more flexible structure (FIG. 3). Hook and loop fastening systems are designed to be peeled apart incrementally over a period of time, as indicated by the line 34 in the plot. The line 32 represents a non-incremental pull, where both of the two structures present in the removing action are rigid, thereby eliminating the time element. A strong separating force must thus be applied over a very short period of time. A need exists in the prior art for an effective and convenient separating assembly, with a fewer number of parts, that allows for easy connection and separation of two rigid structures.

SUMMARY OF THE INVENTION

The rigid structure attachment system of the present invention can effectively and removably secure two rigid structures together. A first section of hook and loop fasteners is attached to a primary rigid structure, and a flange having a number of apertures is connected to a secondary rigid structure. The secondary rigid structure is placed into contact with the primary rigid structure, so that portions of the first section of hook and loop fasteners are accessible through the number of apertures. A second flexible section of hook and loop fasteners is then placed over the apertures within the flange, to thereby contact the first section of hook and loop fasteners secured to the primary rigid structure. The secondary rigid structure is thus secured to the primary rigid structure by the contacting of both the second flexible section of hook and loop fasteners and the first section of hook and loop fasteners.

The rigid structure attachment system of the present invention does not require nuts, bolts or tools for use thereon. Both installation time and removal time can be reduced, since installation only requires the positioning of the flange apertures over the hook and loop fasteners attached to the primary rigid structure, and subsequent placement of a second flexible section of hook and loop fasteners over the apertures of the flange. Removal of the second rigid structure from the primary rigid structure requires only the peeling away of the second flexible section of hook and loop fasteners, and the subsequent removal of the secondary rigid structure from the primary rigid structure.

The flange accommodates variances in vibration and bending between the secondary rigid structure and the primary rigid structure, without damage or debonding to either of the structures or the hook and loop fasteners. Additionally, since the removal of the secondary rigid structure from the primary rigid structure merely requires the peeling away of the second flexible section of hook and loop fasteners, and does not require the exertion of strong forces on the secondary rigid structure, lightweight secondary rigid structures and/or lightweight primary rigid structures may be used without the risk of damage, which has been traditionally associated with typical hook and loop fastening systems.

Another advantage of the present invention stems from the easy alignment of the flange of the secondary structure onto the first section of hook and loop fasteners. Since the apertures of the flange can generally be much larger than apertures for accommodating bolts, a user may look through these apertures to visually move these apertures over the first section of hook and loop fasteners, while the user is moving the secondary rigid structure into contact with the primary rigid structure. Since the rigid structure attachment system of the present invention does not require precise tooling design to assure exact alignment of nuts, bolts and nut plates, the cost of tooling the two rigid structures can be reduced. Moreover, the number of parts is reduced, and the design of the overall system is simplified.

According to one broad aspect of the present invention, a securing system includes a primary structure having a first strip of hook and loop fasteners adapted to be secured thereon. A secondary structure includes a plurality of apertures disposed therein. The plurality of apertures fit over the first strip of hook and loop fasteners when the secondary structure is placed onto the primary structure. A second strip of hook and loop fasteners is adapted for fitting over the plurality of apertures of the secondary structure and for contacting portions of the first strip of hook and loop fasteners through the plurality of apertures. The contacting of the first and second strips of hook and loop fasteners secures the primary structure to the secondary structure. The second strip of hook and loop fasteners is flexible, and is removable from the plurality of apertures with only a relatively small removal force, compared to the removal force required to remove a second rigid strip of hook and loop fasteners from the first strip of hook and loop fasteners on the primary structure.

The secondary structure includes a slot and a plurality of webs traversing the slot. These webs and the slot together form the plurality of apertures. The first strip of hook and loop fasteners and the second strip of hook and loop fasteners sandwich the plurality of webs to thereby hold the secondary structure to the primary structure.

According to another broad aspect of the present invention, a first section of hook and loop fasteners is secured to the primary structure, and a flange adapted for contacting the secondary structure and comprising a plurality of apertures is secured to the secondary structure. The second flexible structure of hook and loop fasteners is adapted for fitting over the flange and for contacting the first section of hook and loop fasteners through the plurality of apparatus of the flange. Both the primary structure and the secondary structure are rigid, and the first and second sections of hook and loop fasteners comprise strips of hook and loop fastener tape. Alternatively, either of the two sections of hook and loop fasteners may include only patches of hook and loop fastener tape. The flange may be integral with the second structure or, alternatively, may be secured to the secondary structure with an adhesive, for example.

The flange may comprise a strip of tape, including a top surface and a bottom surface. A first side of the top surface includes an adhesive, and a second side of the top surface has a plurality of apertures disposed therein. The first side of the top surface contacts the secondary structure, and the plurality of apertures fit over the first section of hook and loop fasteners on the primary structure, and accommodate the second flexible section of hook and loop fasteners thereover. The flange may instead comprise a strip of tape having a top surface and a bottom surface. A perimeter portion of the top surface has an adhesive disposed thereon, and an inner portion of the top surface comprises the plurality of apertures. Either of the two forms of tape may be dispensed from a roll of tape.

The present invention, together with additional features and advantages thereof, may best be understood by reference to the following description taken in connection with the accompanying illustrative drawings.

BRIEF DESCRIPTION OF THE DRAWINGS

FIG. 1 illustrates a conventional hook and loop fastening system used to secure a primary rigid structure to a secondary rigid structure;

FIG. 2 is an enlarged view of the interface between the primary rigid structure and the secondary rigid structure, according to the prior art;

FIG. 3 illustrates the incremental pull, which is best adapted for separating the hooks and loops of a conventional hook and loop fastening system;

FIG. 4 is a plot comparing the differences between a non-incremental pulling force and an incremental pulling force;

DETAILED DESCRIPTION OF THE PRESENTLY PREFERRED EMBODIMENT

Figure 5:
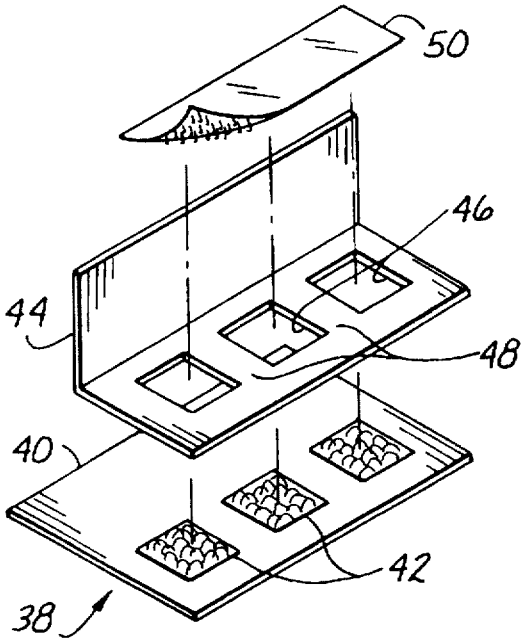
FIG. 5 illustrates an exploded view of the rigid structure attachment system of the present invention according to a first preferred embodiment.

Turning to FIG. 5, a first preferred embodiment of the rigid structure attachment system 38 of the present invention is shown. The rigid structure attachment system 38 comprises a primary rigid structure 40 having a plurality of hook and loop fastener patches 42 disposed thereon. A secondary rigid structure 44 has a plurality of apertures 46 disposed therein. Each of the apertures 46 is separated by a web 48. The secondary rigid structure 44 is placed over the primary rigid structure 40, in order to align the apertures 46 over the hook and loop patches 42. After the plurality of apertures 46 are aligned over the hook and loop fastener patches 42, a hook and loop fastener strip 50 may be placed over the apertures 46, to thereby contact the hook and loop fastener patches 42. The sandwiching of the webs 48 of the secondary rigid structure 44 between the hook and loop fastener strip 50 and the hook and loop fastener patches 42 secures the secondary rigid structure 44 to the primary rigid structure 40. The size of the apertures 46 allows for easy alignment of the apertures 46 over the hook and loop fastener patches 42. Since the hook and loop fastener strip 50 is preferably flexible, the hook and loop fastener strip 50 may be easily peeled away from the hook and loop fastener patches 42. Once the hook and loop fastener strip 50 is peeled away from the hook and loop fastener patches 42, the secondary rigid structure 44 may be removed from the primary rigid structure 40.

Figure 6:
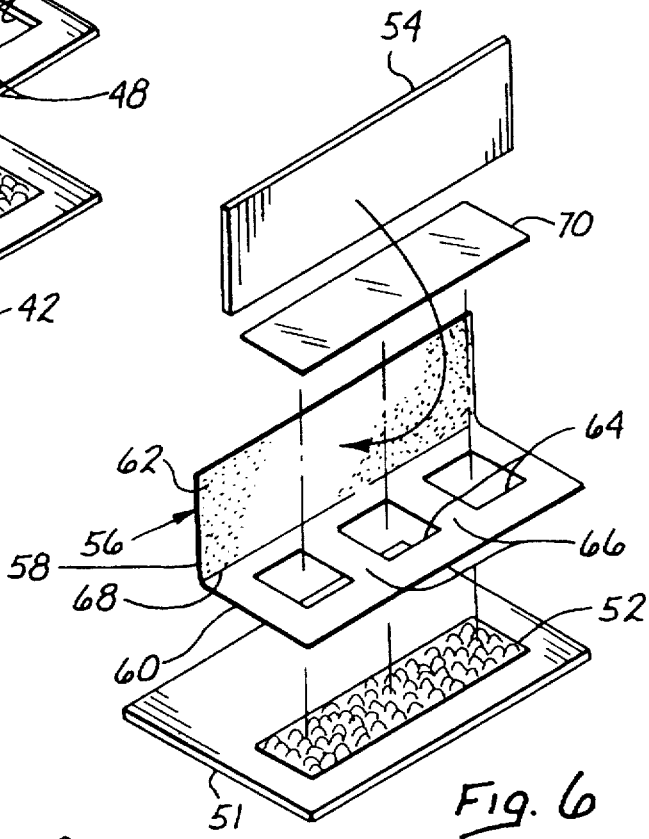
FIG. 6 illustrates an exploded view of the rigid structure attachment system according to a second preferred embodiment.

FIG. 6 illustrates a second preferred embodiment of the rigid structure attachment system, where a primary rigid structure 51 has a hook and loop fastener strip 52 disposed thereon. The secondary rigid structure 54 is secured to the primary rigid structure 51 using a section of tape 56. The section of tape 56 preferably comprises a first half 58 and a second half 60. The first half 58 of the tape 56 preferably comprises an adhesive 62, located on an inner portion thereof, for contacting the secondary rigid structure 54. The second half 60 of the tape 56 comprises a plurality of apertures 64, separated by a plurality of webs 66. The first half 58 and the second half 60 of the tape 56 are separated by a flexible boundary 68.

Although this second preferred embodiment is disclosed using a strip of tape 56, other similar items may be used. For example, a rigid metallic piece with adhesive 62 and apertures 64 may be used or, alternatively, the adhesive 62 may be replaced with nuts and bolts or another conventional securing system. In operation, the tape 56 is secured to the secondary rigid structure 54, and the apertures 64 are placed over the hook and loop fastener strip 52. The hook and loop fastener strip 52 is then placed over the apertures 64, to thereby contact the strip of hook and loop fasteners 52.

Figure 7:
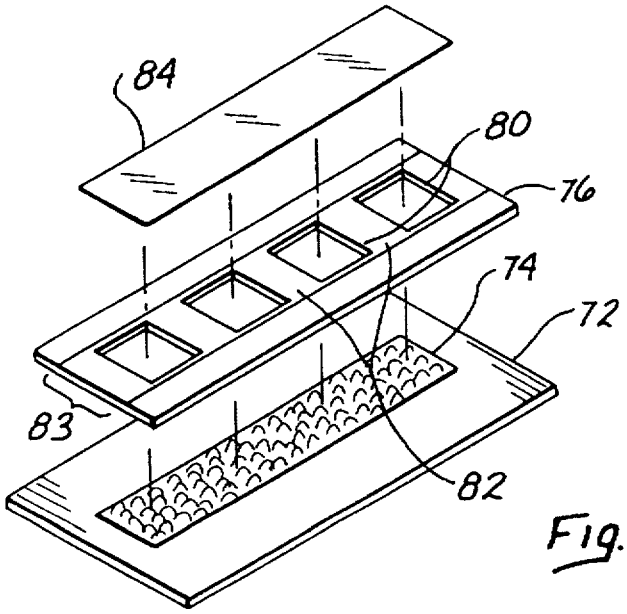
FIG. 7 illustrates an exploded view of the rigid structure attachment system according to a third preferred embodiment.

A third embodiment of the present invention is illustrated in FIG. 7, where a primary rigid structure 72 is shown having a strip of hook and loop fasteners 74 disposed thereon. A secondary rigid structure 76 comprises a plurality of apertures 80, having webs 82 disposed therebetween. The apertures 80 and arms 82 are preferably disposed within a channel 83 of the secondary rigid structure 76. The channel 83 of the secondary rigid structure 76 is preferably slightly recessed, to accommodate the strip of hook and loop fasteners 84 thereover. In order to secure the primary rigid structure 72 to the secondary rigid structure 76, the apertures 80 of the secondary rigid structure 76 are placed over the hook and loop fastener strip 74, and the strip of hook and loop fasteners 84 is placed within the channel 83 of the secondary rigid structure 76. Placement of the strip of hook and loop fasteners 84 within the channel 83 allows portions of the strip of hook and loop fasteners 84 to contact portions of the strip of hook and loop fasteners 74. The channel 83 preferably provides for a flush mounting of the strip of hook and loop fasteners 84 onto the surface of the secondary rigid structure 76. The channel 83, however, is not required.

Figure 8:
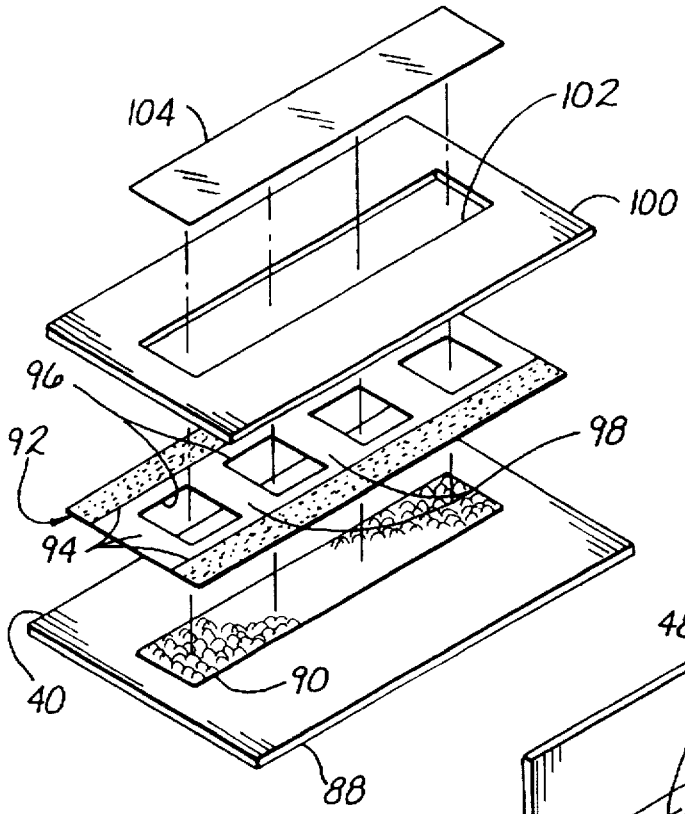
FIG. 8 illustrates an exploded view the rigid structure attachment system according to a fourth preferred embodiment.

A fourth embodiment of the present invention is illustrated in FIG. 8, where a primary rigid structure 88, having a strip of hook and loop fasteners 90 disposed thereon, is secured to a secondary rigid structure 100. As presently preferred, all of the sections of hook and loop fasteners secured to the primary rigid structures are secured using an adhesive, but other securing means may be used, as well. The tape 92 shown in FIG. 8 comprises a perimeter portion 94, which surrounds a plurality of apertures 96 and webs 98. The perimeter portion 94 preferably comprises an adhesive for contacting an underside of the secondary rigid structure 100. The tape 92 is attached to the underside of the secondary rigid structure 100, in such a way that the webs 98 extend across the slot 102 in the secondary rigid structure 100. Once the tape 92 is secured to the underside of the secondary rigid structure 100, the secondary rigid structure 100 is placed onto the primary rigid structure 88 in order to arrange the apertures 96 over the strip of hook and loop fasteners 90. The strip of hook and loop fasteners 104 is then placed over both the slot 102 and the apertures 96 to thereby contact portions of the strip of hook and loop fasteners 90.

Figure 9:
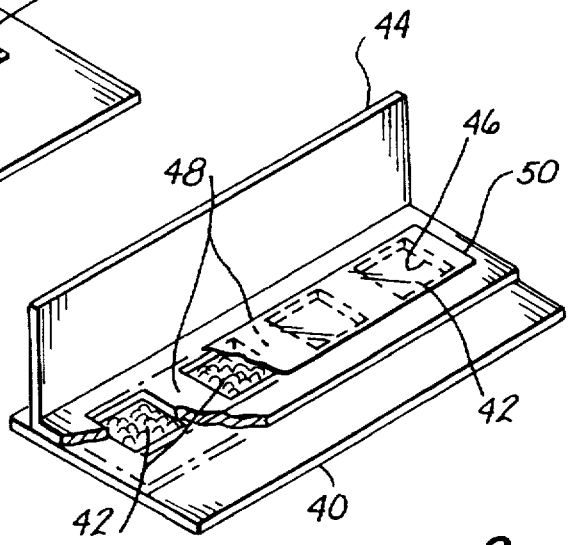
FIG. 9 illustrates the assembly of the rigid structure attachment system according to the first preferred embodiment.

A perspective view of the rigid structure attachment system of the first preferred embodiment in an assembled state is illustrated in FIG. 9. The secondary rigid structure 44 is secured to the primary rigid structure 40, and the strip of hook and loop fasteners 50 is shown contacting both the hook and loop fastener patches 42 (FIG. 5) and the webs 48 of the secondary rigid structure 44.

Figure 10:
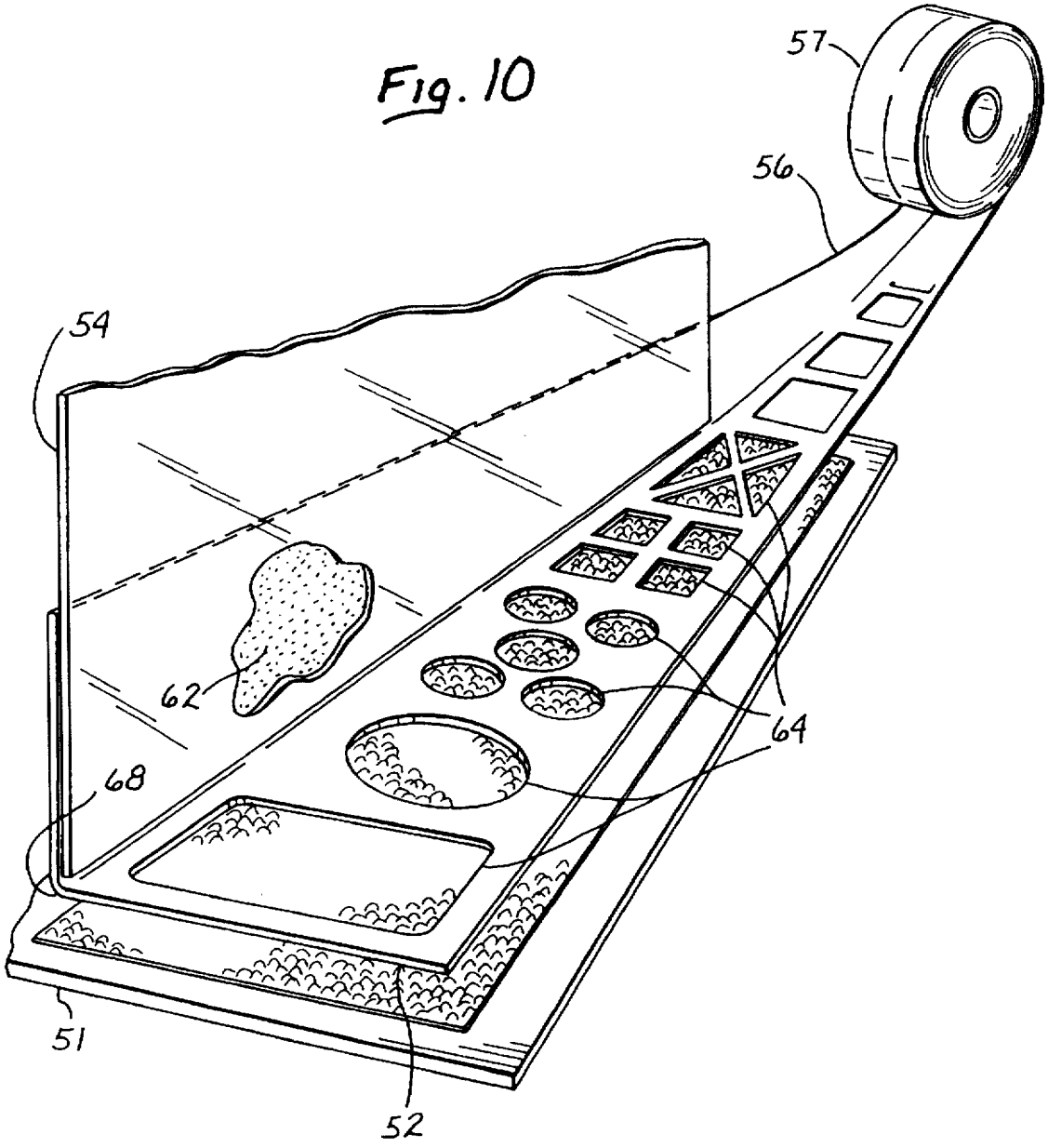
FIG. 10 illustrates the assembly of the rigid structure attachment system according to the second preferred embodiment.

FIG. 10 illustrates a variation of the second preferred embodiment shown in FIG. 6. The tape 56 is shown with a plurality of apertures 64, having different sizes and shapes, disposed therein. Many other different sizes and shapes are possible, according to preference. The tape 56 can be dispensed from a roll of tape 57, for example. Although the strip of hook and loop fasteners 52 is shown as a continuous strip, patches of hook and loop fasteners may be secured onto the primary rigid structure 51 with sizes and shapes corresponding to the sizes and shapes of apertures 64 within the tape 56.

Figure 11:
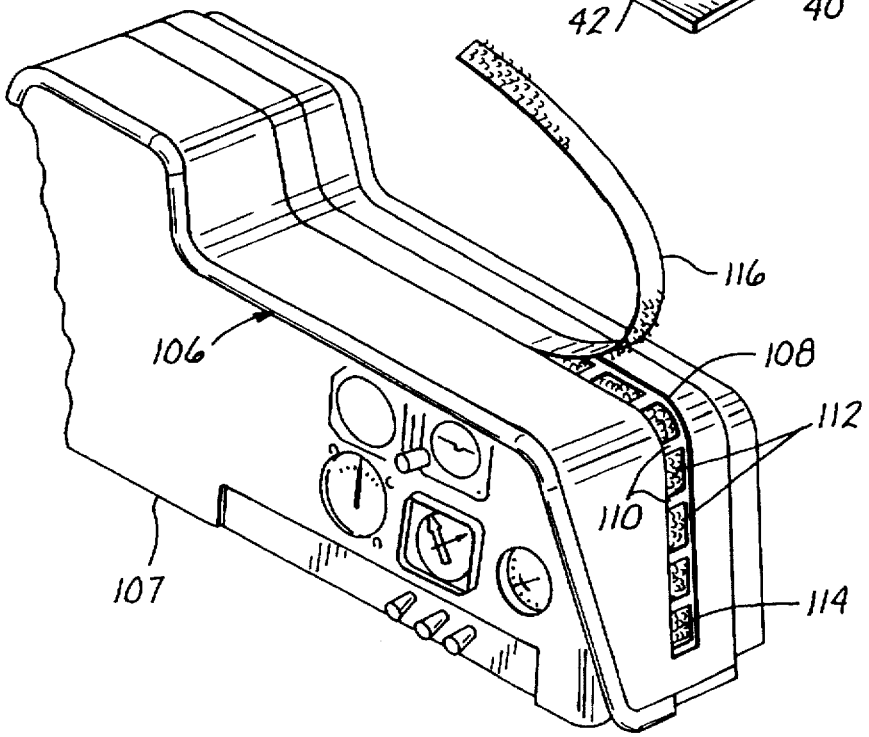
FIG. 11 illustrates the assembly of the rigid structure attachment system according to the third preferred embodiment.

A specific implementation of the third preferred embodiment of the present invention is illustrated in FIG. 11. A glare shield 106 is shown secured to an instrument panel 107 of, for example, an aircraft such as a helicopter. The glare shield 106 comprises a recessed slot 108 and webs 110 extending across the recessed slot 108. Apertures 112 are formed between the webs 110. The glare shield 106 can be secured to the instrument panel 107 by placing the apertures 112 over a first strip of hook and loop fasteners 114, which is secured to the instrument panel 107. A second strip of hook and loop fasteners 116 is then placed over the recessed slot 108 to thereby secure the glare shield 106 to the instrument panel 107. The glare shield 106 may be easily removed from the instrument panel 107 by merely peeling the second strip of hook and loop fasteners 116 away from the recessed slot 108. Prior art hook and loop fastener systems for securing glare shields to instrument panels often resulted in damage to the glare shield or debonding of the hook and loop fastener adhesions, during separation of the glare shield from the instrument panel. With the rigid structure attachment system of the present invention, forces required to separate the glare shield 106 from the instrument panel 107 are minimal and, consequently, the glare shield 106 may be manufactured using lightweight materials.

Figure 12A:
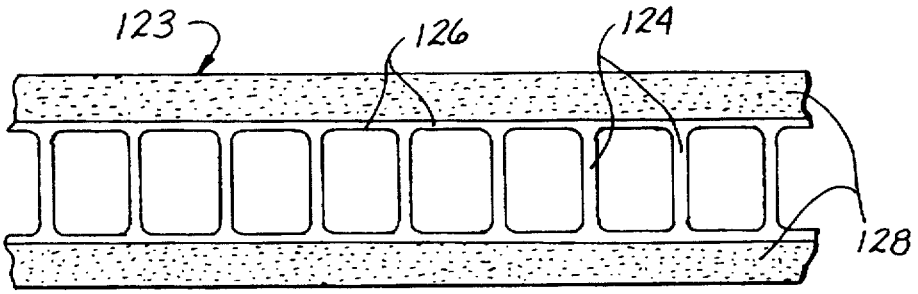
FIGS. 12*a* and 12*b* illustrate an assembly of the rigid structure attachment system according to the fourth preferred embodiment.
Figure 12B:
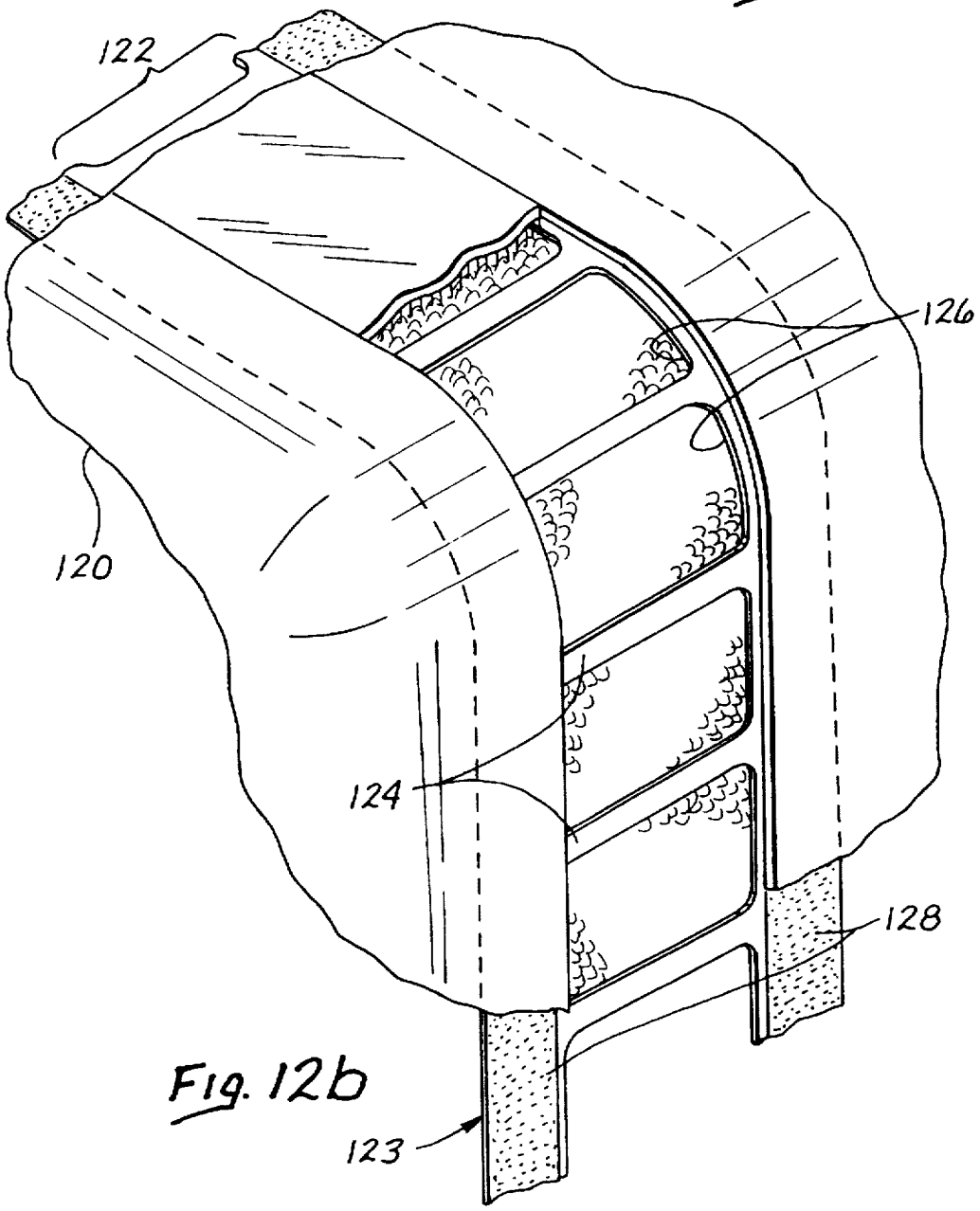

FIG. 12*a* illustrates a strip of tape 123, which is similar to the strip of tape 92 of the fourth preferred embodiment shown in FIG. 8. The strip of tape 123 comprises a plurality of webs 124 and apertures 126. An adhesion area 128 surrounds the webs 124 and apertures 126. As shown in FIG. 12*b*, the adhesion area 128 is placed into contact with an underside of a glare shield 120. Placement of the tape 123 to the underside of the glare shield 120 results in the webs 124 extending across the slot 122 of the glare shield 120. The glare shield 120 shown in FIG. 12*b* can thus be manufactured with a single slot 122, instead of being manufactured with a plurality of apertures 112 as in the embodiment shown in FIG. 11. Once the tape 123 is secured to the underside of the glare shield 120, the glare shield 120 is secured to the instrument panel 107 similarly to that described above with reference to FIG. 11.

Figure 13:
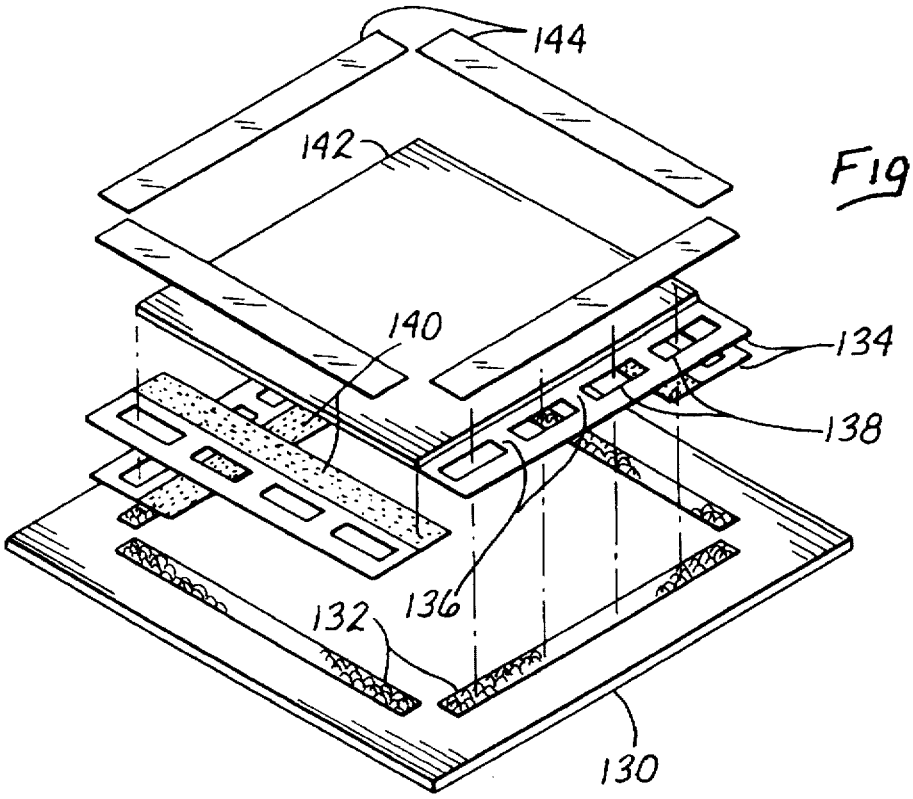
FIG. 13 illustrates an assembly of the rigid structure attachment system according to a fifth preferred embodiment.

FIG. 13 illustrates a fifth preferred embodiment of the rigid structure attachment system of the present invention. A primary structure 130 having a plurality of hook and loop fastener strips 132 disposed thereon can be removably secured to a secondary structure 142, using strips of tape 134 and strips of hook and loop fasteners 144. The four strips of tape 134 are similar to the tape 56 described above with reference to FIG. 6, except that the flexible boundary 68 (FIG. 6) is not required. Each strip of tape 134 comprises a plurality of webs 136 and a plurality of apertures 138. An adhesive portion 140 on each of the strips of tape 134 contacts an underside of the secondary rigid structure 142. The four strips of tape 134 are thus secured to the underside of the secondary rigid structure 142, so that the webs 136 and the apertures 138 are positioned along a perimeter of the secondary rigid structure 142. The secondary rigid structure 142 and the strips of tape 134 are then placed onto the primary rigid structure 130, so that the apertures 138 fit over the strips of hook and loop fasteners 132 secured to the primary rigid structure 130. The strips of hook and loop fasteners 144 are then placed over the apertures 138, to thereby secure the secondary rigid structure 142 to the primary rigid structure 130.

Figure 14:
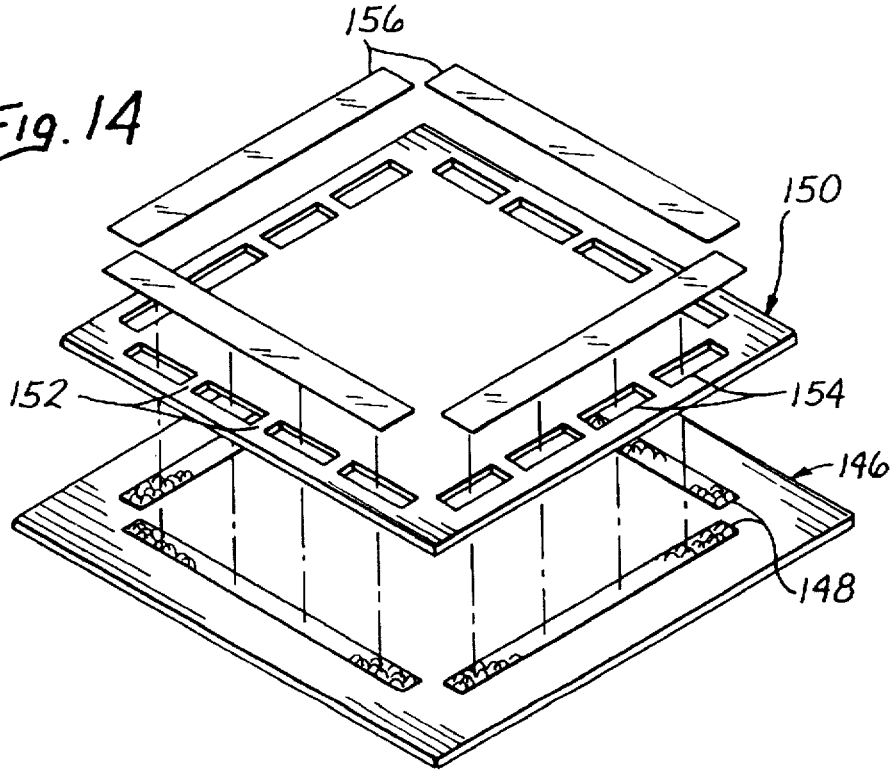
FIG. 14 illustrates an assembly of the rigid structure attachment system according to a sixth preferred embodiment.

FIG. 14 illustrates a sixth preferred embodiment of the present invention, where a primary rigid structure 146, having a plurality of strips of hook and loop fasteners 148 secured thereon, is removably connected to a secondary rigid structure 150. The secondary rigid structure 150 preferably comprises a plurality of webs 152 and a plurality of apertures 154. The second rigid structure 150 is placed onto the primary rigid structure 146, so that the plurality of apertures 154 fit over the plurality of hook and loop fastener strips 148. The four strips of hook and loop fasteners 156 are then placed over the plurality of apertures 154, to thereby contact the four strips of hook and loop fasteners 148 and to removably secure the secondary rigid structure 150 to the primary rigid structure 146. As with the other embodiments of the present invention, the strips of hook and loop fasteners 156 may be removed without significantly affecting either the secondary rigid structure 150 or the primary rigid structure 146. In this or any of the other previously described embodiments, the ratio of the aperture size, shape, and number of either the tape or the secondary rigid structure, relative to the length of the length and width of the hook and loop fastener tape, may be varied according to design preference. Also, entire strips of hook and loop fastener tape, or portions of hook and loop fastener tape, may be used according to design considerations, such as holding strength and cost.

Although an exemplary embodiment of the invention has been shown and described, many other changes, modifications and substitutions, in addition to those set forth in the above paragraphs, may be made by one having ordinary skill in the art without necessarily departing from the spirit and scope of this invention.

What is claimed is:

1. A rigid structure securing system for securing a secondary structure to a primary structure, comprising:

a primary rigid structure; a secondary rigid structure;

a first section of hook-and-loop fasteners secured to the primary structure, the secondary structure comprising a plurality of apertures, the plurality of apertures defining an area having a length and a width; and a second flexible section of hook-and-loop fasteners fitting over the plurality of apertures, and contacting the first section of hook-and-loop fasteners through the plurality of apertures;

wherein the secondary structure is secured to the primary structure by engagement of the second flexible section of hook-and-loop fasteners and the first section of hook-and-loop fasteners.

2. The securing system as recited in claim 1, the primary structure being planar, and the secondary structure being planar.

3. The securing system as recited in claim 1, the first section of hook-and-loop fasteners and the second section of hook-and-loop fasteners comprising strips of hook-and-loop fasteners.

4. The securing system as recited in claim 1, at least one of the first section of hook-and-loop fasteners and the second section of hook-and-loop fasteners comprising a plurality of patches of hook-and-loop fasteners corresponding to the plurality of apertures.

5. The securing system as recited in claim 1, the first strip of hook-and-loop fasteners being secured to the primary structure with an adhesive.

6. The securing system as recited in claim 1, the apertures being integral with the secondary structure.

7. The securing system as recited in claim 6, the apertures being located along a perimeter of the secondary structure.

8. The securing system as recited in claim 6, the apertures being located in a central portion of the secondary structure.

9. The securing system as recited in claim 1, the apertures being disposed in a flange, which is secured to the secondary structure with an adhesive.

10. The securing system as recited in claim 9, the flange comprising at least one strip of tape having a plurality of webs disposed thereon, the plurality of apertures being located between the plurality of webs.

11. The securing system as recited in claim 10, the tape being dispensable from a roll of tape.

12. The securing system as recited in claim 10, the flange being located along a perimeter of the secondary structure.

13. The securing system as recited in claim 12, the strip of tape having a top surface, a bottom surface, a length, a width, and a line running along the length and bisecting the width into a first half and a second half.

14. The securing system as recited in claim 13, the second half comprising the plurality of apertures, and the top of the first half comprising an adhesive for contacting a portion of the secondary structure.

15. The securing system as recited in claim 14, the secondary structure comprising four sides, and the at least one strip of tape comprising four strips of tape, one of the four strips of tape being secured to each of the four sides of the secondary structure, and the first section of hook-and-loop fasteners comprising four strips of hook-and-loop fasteners, each of the four strips of hook-and-loop fasteners being secured on the primary structure to correspond to one of the second halves of each of the four strips of tape.

16. The securing system as recited in claim 10, the flange being located in a central portion of the secondary structure.

17. The securing system as recited in claim 16, the secondary structure comprising a slot located in the central portion of the secondary structure, and the flange being located in the central portion of the secondary structure, so that the plurality of webs of the at least one strip of tape extend across the slot.

18. The securing system as recited in claim 17, the strip of tape having a top surface and a bottom surface, each of the top surface and the bottom surface having a perimeter area surrounding the plurality of apertures, each of the plurality of apertures extending through the tape from the top surface of the tape to the bottom surface of the tape.

19. A rigid structure securing system, comprising:

a primary rigid structure;

a first strip of hook-and-loop fasteners secured to the primary structure;

a secondary rigid structure;

a plurality of apertures disposed in the secondary structure, the plurality of apertures defining an area having a length and a width and fitting over the first strip of hook-and-loop fasteners with the secondary structure placed onto the primary structure; and a second strip of hook-and-loop fasteners fitting over the plurality of apertures of the secondary structure and contacting portions of the first strip of hook-and-loop fasteners through the plurality of apertures, the contacting of the first and second strips of hook-and-loop fasteners securing the primary structure to the secondary structure, the second strip of hook-and-loop fasteners being adapted to be removed from the plurality of apertures by sequentially peeling the second strip of hook-and-loop fasteners from contact with the portions of the first strip of hook-and-loop fasteners along the length of the area defined by the plurality of apertures.

20. The securing system as recited in claim 19, the second strip of hook-and-loop fasteners being flexible, and being removable from the plurality of apertures with a relatively small removal force, compared to a removal force required to remove a second rigid strip of hook-and-loop fasteners from the first strip of hook-and-loop fasteners on the primary structure.

21. The securing system as recited in claim 19, the secondary structure comprising a slot and a plurality of webs running across the slot and transversing the slot, and wherein the first strip of hook-and-loop fasteners and the second strip of hook-and-loop fasteners sandwich the plurality of webs to thereby hold the secondary structure to the primary structure.

22. A rigid structure securing system for securing a secondary rigid structure to a primary rigid structure, comprising:

a first section of hook-and-loop fasteners secured to the primary rigid structure;

a second section of hook-and-loop fasteners removably contacting the first section of hoop-and-loop fasteners; and a flange connected to the secondary rigid structure and comprising a plurality of apertures, the flange being sandwiched between the first section of hook-and-loop fasteners and the second section of hook-and-loop fasteners, wherein the first section of hook-and-loop fasteners and the second section of hook-and-loop fasteners contact each other through the plurality of apertures of the flange.

23. A securing system, comprising:

a primary structure having a rigid planar surface;

a first strip of hook-and-loop fasteners secured to the rigid planar surface of the primary structure;

a secondary structure having a rigid planar surface, a slot, and a plurality of webs extending over the slot, the plurality of webs fitting over the first strip of hook-and-loop fasteners; and a flexible second strip of hook-and-loop fasteners fitting over the plurality of webs, portions of the second strip of hook-and-loop fasteners fitting around the plurality of webs and contacting portions of the first strip of hook-and-loop fasteners, to thereby secure the primary structure to the secondary structure, with the flexible second strip of hook-and-loop fasteners placed over the plurality of webs, wherein the slot is surrounded by four sides, and wherein the plurality of webs form a plurality of apertures within the slot.

24. The securing system as recited in claim 23, wherein the slot is surrounded by only three sides.

25. A rigid structure securing system for securing a secondary structure to a primary structure, comprising:

a primary rigid structure; a secondary rigid structure;

a first section of hook-and-loop fasteners secured to the primary structure, the secondary structure comprising a plurality of apertures; and a second flexible section of hook-and-loop fasteners fitting over the plurality of apertures, and contacting the first section of hook-and-loop fasteners through the plurality of apertures, the apertures being disposed in a flange, which is secured to the secondary structure with an adhesive;

wherein the secondary structure is secured to the primary structure by engagement of the second flexible section of hook-and-loop fasteners and the first section of hook-and-loop fasteners.

* * * * *